US007981587B2

(12) United States Patent
Aoki et al.

(10) Patent No.: US 7,981,587 B2
(45) Date of Patent: Jul. 19, 2011

(54) DEVELOPING AGENT AND METHOD FOR PRODUCING THE SAME

(75) Inventors: Takayasu Aoki, Mishima (JP); Masahiro Ikuta, Mishima (JP); Tsuyoshi Itou, Izunokuni (JP); Takashi Urabe, Sunto-gun (JP); Motonari Udo, Mishima (JP); Satoshi Araki, Izunokuni (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 390 days.

(21) Appl. No.: 11/924,821

(22) Filed: Oct. 26, 2007

(65) Prior Publication Data

US 2008/0102398 A1 May 1, 2008

Related U.S. Application Data

(60) Provisional application No. 60/863,262, filed on Oct. 27, 2006.

(30) Foreign Application Priority Data

Sep. 19, 2007 (JP) ..... 2007-242974

(51) Int. Cl.
*G03G 9/08* (2006.01)

(52) U.S. Cl. ..... 430/137.14; 430/109.1; 430/137.1

(58) Field of Classification Search ..... 430/109.1, 430/137.1, 137.14

See application file for complete search history.

(56) References Cited

U.S. PATENT DOCUMENTS

| | | | | |
|---|---|---|---|---|
| 6,962,764 | B2 | 11/2005 | Vanbesien et al. | |
| 2006/0166121 | A1 * | 7/2006 | Patel et al. | 430/109.4 |
| 2006/0194135 | A1 * | 8/2006 | Hayashi et al. | 430/108.4 |
| 2006/0263711 | A1 * | 11/2006 | Yuasa et al. | 430/108.4 |
| 2006/0292476 | A1 * | 12/2006 | Maehata et al. | 430/109.4 |

FOREIGN PATENT DOCUMENTS

| | | |
|---|---|---|
| JP | 02-061650 | 3/1990 |
| JP | 02-259770 | 10/1990 |
| JP | 10-026842 | 1/1998 |
| JP | 11-060739 | 3/1999 |
| JP | 2002-006550 | 1/2002 |
| JP | 2005-062887 | 3/2005 |

* cited by examiner

*Primary Examiner* — Hoa V Le
(74) *Attorney, Agent, or Firm* — Turocy & Watson, LLP

(57) ABSTRACT

A method for producing a developing agent including heating a dispersion of a toner particle material containing a binder resin fine particle, a coloring agent particle and a dispersion medium at a temperature of a glass transition point of the binder resin or higher and adding a coagulating agent in the heated dispersion of a toner particle material to coagulate a toner material containing the binder resin fine particle and the coloring agent particle, thereby forming a coagulated particle is disclosed.

5 Claims, 2 Drawing Sheets

DEVELOPING AGENT AND METHOD FOR PRODUCING THE SAME

CROSS-REFERENCE TO RELATED APPLICATIONS

This application is based upon and claims the benefit of priority from the provisional Patent Application No. 60/863,262, filed Oct. 27, 2006, the entire contents of which are incorporated herein by reference.

This application is based upon and claims the benefit of priority from prior Japanese Patent Application No. 2007-242974, filed Sep. 19, 2007, the entire contents of which are incorporated herein by reference.

BACKGROUND OF THE INVENTION

1. Field of the Invention

The present invention relates to a method for producing a developing agent for developing an electrostatic charge image or a magnetic latent image in electrophotography, electrostatic printing, magnetic recording and the like.

2. Description of the Related Art

In the related-art production method of an electrophotographic toner, a kneading pulverization method was the main current. In the case of a toner particle to be produced by the kneading pulverization method, in general, its shape was amorphous, and its surface composition was heterogeneous. Though the shape or surface composition of the toner particle subtly may change depending upon pulverization properties of a material to be used or conditions of a pulverization step, it was difficult to intentionally control the shape. Also, the kneading pulverization method was limited in making the particle size small. Mechanical pulverization of a toner go through steps of pulverization, classification and the like. When the particle size became small, the yield was lowered due to a lowering of the efficiency in the classification, and necessary energy increased.

On the other hand, with the diffusion of a digital color system aiming at a high image quality of these days, needs for realizing a small particle size of a toner have increased. The small-sized toner is able to increase a coverage on a medium such as paper at a low consumption amount and is especially advantageous for colorization of electrophotography.

Also, from the viewpoint of enhancing transfer properties and fixability, it has been demanded to precisely control a toner particle regarding the toner shape, particle size distribution and encapsulation and the like. As a production method which meets these demands, the production of a toner by a polymerization method is exemplified.

As the method for producing a toner by a polymerization method, there are an emulsion polymerization coagulation method, a suspension polymerization method, a solution suspension method and the like. Among these methods, in order to meet the foregoing precise control of a toner particle, an emulsion polymerization coagulation method is advantageous as described in JP-A-2-61650 and JP-A-2-259770. This method is a technology for obtaining a targeted particle size by forming a resin fine particle by emulsion polymerization and then performing coagulation. According to this method, though there is a possibility that a particle having a small particle size and having controlled particle shape and particle size distribution is obtained, a step of coagulating a fine particle is essential.

With respect to the coagulation method, it is general to obtain a particle having desired particle size and particle size distribution by using an inorganic metal salt or the like as a coagulating agent and changing the operation temperature and stirring state in the coagulation step. For example, there is a technology for coagulating a dispersed resin particle at a temperature of not higher than a glass transition point thereof as disclosed in Japanese Patent No. 3141783 and JP-A-2005-62887. Alternatively, for example, there is a technology for controlling a power required for stirring as disclosed in Japanese Patent No. 3610543.

In the case where a styrene based resin is used as a binder resin, it is possible to produce a small-sized toner by employing the foregoing emulsion coagulation method. However, in recent color toners, since fixability is required at a lower temperature, a resin having a low glass transition point is suitable, and polyester based resins are frequently used.

However, coagulation with respect to a polyester based resin was studied. As a result, there were obtained only materials in which the viscosity of a solution increases, whereby stirring becomes impossible, or even when coagulation is possible, the amount of coarse particles is remarkably high. Such became more remarkable as the concentration of solids of the resin at the coagulation increased.

It is thought that this is caused due to the matter that the solution exhibits thixotropy because a resin having a terminal functional group as in polyester based resins has a network structure where the functional group is organically coupled.

Also, for example, there is a method for obtaining a atomized binder resin by dissolving a binder resin in an organic solvent, adding dropwise water in the mixture to achieve inverse emulsification and removing the organic solvent as disclosed in JP-A-2002-6550. Though this method is known as a method for atomizing a resin, and therefore, a step of removing the organic solvent is included, the steps became complicated. Also, this method involved a problem that the organic solvent adversely affects the environment.

BRIEF SUMMARY OF THE INVENTION

An object of the invention is to obtain a developing agent having a small particle size and containing less coarse particles by coagulating a toner material without thickening a dispersion containing the toner material.

A method for producing a developing agent according to the invention includes steps of:

heating a dispersion of a toner particle material containing a binder resin fine particle, a coloring agent particle and a dispersion medium at a temperature of a glass transition point of the binder resin or higher and adding a coagulating agent in the heated dispersion of a toner particle material to coagulate a toner material containing the binder resin fine particle and the coloring agent particle, thereby obtaining a coagulated particle; and removing the dispersion medium from the dispersion containing the coagulated particle, thereby obtaining a toner particle.

Also, a developing agent according to the invention is one obtained by employing a method for producing a developing agent including steps of:

heating a dispersion of a toner particle material containing a binder resin fine particle, a coloring agent particle and a dispersion medium at a temperature of a glass transition point of the binder resin or higher and adding a coagulating agent in the heated dispersion of a toner particle material to coagulate a toner material containing the binder resin fine particle and the coloring agent particle, thereby obtaining a coagulated particle; and removing the dispersion medium from the dispersion containing the coagulated particle, thereby obtaining a toner particle, the developing agent containing a toner particle having a volume average particle size of from 2 to 10 μm and containing from 0 to 5% by volume of a toner particle having a particle size of 10 μm or more relative to the volume of the whole of toner particles.

According to the invention, a developing agent having a small particle size and containing less coarse particles is obtained by coagulating a toner material without thickening a dispersion containing the toner material.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A method for producing a developing agent according to the invention includes the steps of preparing a dispersion of a toner particle material containing a binder resin fine particle, a coloring agent particle and a dispersion medium, heating the dispersion at a temperature of a glass transition point of the binder resin or higher and adding a coagulating agent in the heated dispersion of a toner particle material to coagulate a toner material containing the binder resin fine particle and the coloring agent particle, thereby obtaining a coagulated particle; and removing the dispersion medium from the dispersion containing the obtained coagulated particle, thereby obtaining a toner particle.

Figure 1:
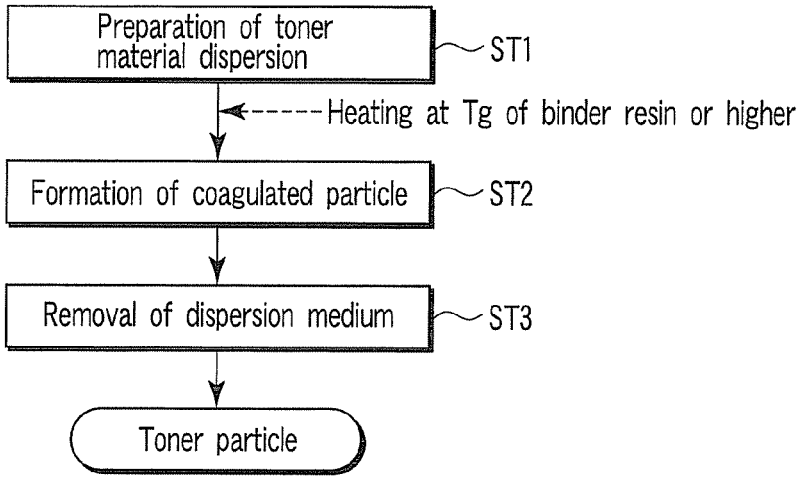
FIG. 1 shows a flow diagram expressing a representative embodiment of a method for producing a developing agent according to the invention.

FIG. 1 shows a flow diagram expressing a representative embodiment of a method for producing a developing agent according to the invention.

As shown in FIG. 1, in the method for producing a developing agent according to the invention, first of all, a dispersion of a toner particle material containing a binder resin fine particle, a coloring agent particle and a dispersion medium is prepared (ST1). Next, the resulting dispersion is heated at a temperature of a Tg of the binder resin or higher, and a coagulating agent is added in the heated dispersion of a toner particle material to coagulate a toner material containing the binder resin fine particle and the coloring agent particle, thereby forming a coagulated particle (ST2). Furthermore, the dispersion medium is removed from the dispersion containing the coagulated particle, thereby obtaining a toner particle (ST3).

Also, the developing agent of the invention is obtained by employing the foregoing method and contains a toner particle having a volume average particle size of from 2 to 10 μm and contains from 0 to 5% by volume of a toner particle having a particle size of 10 μm or more relative to the volume of the whole of toner particles.

According to the invention, by adding the coagulating agent at a temperature of a glass transition point of the binder resin or higher to achieve rapid coagulating, a coagulated particle having a narrow particle size distribution and containing less coarse particles is obtained without increasing a viscosity of the dispersion. When such a coagulated particle is used as a toner, a developing agent having satisfactory fixability and transfer properties is obtained.

The toner particle material which is used in the invention contains at least a binder resin fine particle and a coloring agent, and its dispersion further contains a dispersion medium.

An additive, for example, a wax and a charge controlling agent can be added in the toner particle material as the need arises.

The toner material dispersion can be obtained by, for example, individually preparing a binder resin finer particle dispersion, a coloring agent particle dispersion and a wax dispersion in advance and mixing them before coagulation. At that time, for example, an additive such as a charge controlling agent can be added in the binder resin fine particle dispersion.

Alternatively, with respect to the toner material dispersion, a fine particle dispersion can be prepared by melt kneading toner materials such as a resin, a pigment, a wax and a charge controlling agent by using a melt kneader, atomizing its pulverized material by using a device for imparting mechanical shearing or the like and then dispersing the resulting fine particle in a dispersion medium.

Atomization of the foregoing pulverized material of a melt kneaded material and atomization of each of the foregoing binder resin fine particle dispersion, coloring agent particle dispersion and wax dispersion can be respectively achieved by using a device for imparting mechanical shearing or the like.

In the invention, the device for achieving atomization imparting mechanical shearing is not particularly limited. Examples thereof include medium-free stirrers such as ULTRA TURRAX (manufactured by IKA Japan K.K.), T.K. AUTO HOMO MIXER (manufactured by PRIMIX Corporation), T.K. PIPELINE HOMO MIXER (manufactured by PRIMIX Corporation), T.K. FILMICS (manufactured by PRIMIX Corporation), CLEAR MIX (manufactured by MTECHNIQUE Co., Ltd.), CLEAR SS5 (manufactured by MTECHNIQUE Co., Ltd.), CAVITRON (manufactured by EUROTEC, Ltd.) and FINE FLOW MILL (manufactured by Pacific Machinery & Engineering Co., Ltd.); and high-pressure homogenizer types such as a Manton-Gaulin type high-pressure homogenizer (manufactured by Niro Soavi), MICROFLUIDIZER (manufactured by Mizuho Industrial Co., Ltd.), NANO-MIZER (manufactured by Nano-Mizer), ULTIMIZER (manufactured by Sugino Machine Limited), GENUS PY (manufactured by Hakusui Chemical Industries, Ltd.) and NANO300 (manufactured by Biryu Co., Ltd.).

Examples of the melt kneader which is used in the invention include a single-screw extruder, a twin-screw extruder, a pressure kneader, a Banbury mixer and a Brabender mixer. Concretely, there are exemplified FCM (manufactured by Kobe Steel, Ltd.), NCM (manufactured by Kobe Steel, Ltd.), LCM (manufactured by Kobe Steel, Ltd.), ACM (manufactured by Kobe Steel, Ltd.), KTX (manufactured by Kobe Steel, Ltd.), GT (manufactured by Ikegai, Ltd.), PCM (manufactured by Ikegai, Ltd.), TEX (manufactured by The Japan Steel Works, Ltd.), TEM (manufactured by Toshiba Machine Co., Ltd.), ZSK (manufactured by Warner K.K.) and KNEADEX (manufactured by Mitsui Mining Co., Ltd.).

Furthermore, for the production of a resin fine particle dispersion by atomizing the binder resin, in the case of a styrene based resin, emulsion polymerization can be employed. On the other hand, in the case of a polyester based resin, since it is of a polycondensation type, the polymerization in water is basically difficult. Then, it is possible to achieve atomization of a resin by mechanical shearing by adding an emulsifier or the like in a material obtained by pulverizing a polyester resin obtained through polycondensation or a material obtained by mixing a coloring agent or a wax in a polyester resin, kneading the mixture by a kneader and pulverizing the resulting mixture, or the like. Alternatively, it is also possible to achieve atomization of a resin by a chemical method such as inverse emulsification not depending upon the mechanical shearing.

Examples of the binder resin which is used in the invention include styrene/acrylic copolymers, polyethylene/vinyl acetate copolymers, polyester based resins, acrylic resins, phenol based resins, epoxy based resins, allyl phthalate based resin, polyamide based resins and maleic acid based resins. These resins may be used singly or in combination of two or more kinds thereof. Of these, polyester based resins having an acidic polar group are desirable. The polyester resin is obtained by using a monomer containing a carboxylic acid component composed of a polyhydric carboxylic acid compound having a valence of 2 or more and an alcohol component composed of a polyhydric alcohol having a valence of 2 or more. Examples of the acid component include fumaric acid, maleic acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, succinic acids substituted with an alkyl group having from 1 to 20 carbon atoms or an alkenyl group having from 2 to 20 carbon atoms, such as dodecenylsuccinic acid and octylsuccinic acid, and derivatives of these acids such as anhydrides and alkyl esters. Examples of the alcohol component include aliphatic polyols such as ethylene glycol, propylene glycol, 1,4-butanediol, 1,3-butanediol, 1,5-pentanediol, 1,6-hexanediol, neopentylene glycol, glycerin, trimethylolethane, trimethylolpropane and pentaerythritol; alicyclic polyols such as 1,4-cyclohexanediol and 1,4-cyclohexanedimethanol; and ethylene oxide or propylene oxide adducts such as bisphenol A. These may be used singly or in admixture of two or more kinds thereof.

An acid value of the polyester resin is desirably 2 or more and not more than 40, and more desirably 5 or more and not more than 35. When the acid value is less than 2, it is difficult to atomize the resin in an aqueous system, whereas when the acid value exceeds 40, the hygroscopicity becomes worse, and therefore, the charge characteristic of the toner tends to become deteriorated.

A glass transition temperature of the polyester resin is desirably 45° C. or higher and not higher than 70° C., and more desirably 50° C. or higher and not higher than 65° C. When the glass transition point temperature is lower than 45° C., the heat-resistant preservability of the toner is deteriorated, whereas it exceeds 70° C., the low-temperature fixability is deteriorated.

A weight average molecular weight Mw of the polyester resin is desirably 5,000 or more and not more than 50,000, and more desirably 8,000 or more and not more than 20,000. When the weight average molecular weight Mw is less 5,000, the elasticity of the toner is lowered, and the high-temperature offset resistance is lowered. When the Mw exceeds 50,000, the low-temperature fixability tends to be lowered.

The binder resin which is used in the invention can be, for example, used in a shape of a fine particle dispersed in a dispersion medium such as aqueous solvents. The term "fine particle" as referred to herein means a particle having a volume average particle size of from 50 nm to 1 μm. Also, a binder resin fine particle having a volume average particle size of from 50 nm to 500 nm can be preferably used. When the volume average particle size falls within this range, the stability of the dispersion containing a binder resin fine particle becomes more satisfactory.

Examples of the coloring agent which is used in the invention include carbon black and organic or inorganic pigments or dyes. Though there are no particular limitations, examples of the carbon black include acetylene black, furnace black, thermal black, channel black and ketjen black. Examples of the pigment or dye include Fast Yellow G, Benzidine Yellow, Indo Fast Orange, Irgazin Red, Naphthol Azo, Carmine FB, Permanent Bordeaux FRR, Pigment Orange R, Lithol Red 2G, Lake Red C, Rhodamine FB, Rhodamine B Lake, Phthalocyanine Blue, Pigment Blue, Brilliant Green B, Phthalocyanine Green and quinacridone. These can be used singly or in admixture.

In the invention, an arbitrary wax can be used as the toner material. Examples thereof include aliphatic hydrocarbon based waxes such as low molecular weight polyethylene, low molecular weight polypropylene, polyolefin copolymers, polyolefin waxes, microcrystalline waxes, paraffin waxes and Fischer-Tropsch waxes; oxides of an aliphatic hydrocarbon based wax such as polyethylene oxide waxes or block copolymers thereof; vegetable waxes such as candelilla wax, carnauba wax, Japan wax, jojoba wax and rice wax; animal waxes such as bees wax, lanolin and whale wax; mineral waxes such as ozokerite, ceresin and petrolactam; waxes containing, as a main component, a fatty acid ester such as montanic acid ester wax and castor wax; and materials obtained by deoxidization of a part or the whole of a fatty acid ester such as deoxidized carnauba wax. Furthermore, there are exemplified saturated linear fatty acids such as palmitic acid, stearic acid, montanic acid and long chain alkylcarboxylic acids having a longer chain alkyl group; unsaturated fatty acids such as brassylic acid, eleostearic acid and parinaric acid; saturated alcohols such as stearyl alcohol, eicosyl alcohol, behenyl alcohol, carnaubyl alcohol, ceryl alcohol, melissyl alcohol and long chain alkyl alcohols having a longer chain alkyl group; polyhydric alcohols such as sorbitol; fatty acid amides such as linoleic acid amide, oleic acid amide and lauric acid amide; saturated fatty acid bisamides such as methylenebisstearic acid amide, ethylenebiscaprylic acid amide, ethylenebislauric acid amide and hexamethylenebisstearic acid amide; unsaturated fatty acid amides such as ethylenebisoleic acid amide, hexamethylenebisoleic acid amide, N,N'-dioleyladipic acid amide and N,N'-dioleylsebaccic acid amide; aromatic bisamides such as m-xylenebisstearic acid amide and N,N'-distearylisophthalic acid amide; fatty acid metal salts (generally called metallic soaps) such as calcium stearate, calcium laurate, zinc stearate and magnesium stearate; waxes obtained by grafting of a vinyl based monomer such as styrene and acrylic acid on an aliphatic hydrocarbon based wax; partial esterification products between a fatty acid and a polyhydric alcohol such as behenic acid monoglyceride; and methyl ester compounds having a hydroxyl group obtained by hydrogenation of a vegetable fat and oil.

In the invention, for the purpose of controlling a triboelectrostatic charge quantity, a charge controlling agent or the like can be blended into the toner material. As the charge controlling agent, a metal-containing azo compound is used, and complexes or complex salts in which a metal element thereof is iron, cobalt or chromium, or mixtures thereof are desired. A metal-containing salicylic acid derivative compound is also used, and complexes or complex salts in which a metal element thereof is zirconium, zinc, chromium or boron, or mixtures thereof are desired.

As the dispersion medium which is used in the toner material dispersion, an aqueous solvent, for example, ion exchanged water can be used. In the invention, sufficient dispersibility is obtainable even by using an aqueous solvent, and a developing agent having a small particle size and containing less coarse particles is obtainable by coagulating the toner material without thickening the dispersion in which the toner material is contained. Ion exchanged water has advantages that it is sufficiently low in costs and that it is environmentally friendly as compared with organic solvents.

In the invention, in atomizing the resin, coloring agent and wax, a surfactant may be used in the toner material dispersion.

Examples of an anionic surfactant include sulfonic acid salts such as alkylbenzenesulfonates, alkylnaphthalenesulfonates, alkyl diphenyl ether disulfonates and alkanesulfonates; fatty acid salts such as oleic acid salts, stearic acid salts and palmitic acid salts; sulfuric acid ester salts such as lauryl sulfate salts and lauryl ether sulfate salts; and alkenyl succinic acid salts.

Examples of a cationic surfactant include amine salts such as laurylamine salts, oleylamine salts and stearylamine salts; and quaternary ammonium salts such as lauryltrimethylammonium salts, stearyltrimethylammonium salts, distearyldimethylammonium salts and alkylbenzyldimethylammonium salts.

Examples of a nonionic surfactant include polyoxyethylene alkyl ethers such as polyoxyethylene lauryl ether, polyoxyethylene stearyl ether and polyoxyethylene myristyl ether; polyoxyalkylene alkyl ethers such as polyoxyethylene alkylene alkyl ethers and polyoxyethylene polyoxypropylene glycol; and sorbitan fatty acid esters such as sorbitan monolaurate, sorbitan monopalmitate and sorbitan monostearate.

The dispersion of the toner particle material is heated at a coagulation temperature for achieving the coagulation.

This coagulation temperature is a temperature of a glass transition point of the binder resin or higher.

The formation of a coagulated particle is carried out by adding a coagulating agent in the dispersion of the toner particle material at a temperature of a glass transition point of the binder resin or higher. Also, at that time, the dispersion of the toner particle material can be stirred.

The formation of a coagulated particle can also be carried out while measuring the viscosity. Furthermore, the formation of a coagulated particle can be carried out while measuring the temperature.

It is preferable that the coagulated particle has a volume average particle size of from 3.0 μm to 10.0 μm.

For the purpose of controlling the formation of a coagulated particle so as to have a desired volume average particle size, arbitrary stirring is continued until a desired particle size is obtained by measuring the particle size of the coagulated particle by a particle size analyzer while measuring the coagulation temperature and the viscosity.

Alternatively, the volume average particle size of the coagulated particle can be controlled by controlling the kind and amount of each of the surfactant and the coagulating agent, a temperature pattern at the coagulation, the kind and revolution number of a stirring blade, and the like.

In the invention, with respect to a method for measuring the viscosity of the dispersion in the step of forming a coagulated particle, as a method for the measurement by sampling a solution, a single cylindrical rotational viscometer (B type viscometer), a cone-plate type rotational viscometer (TVE-22; Toki Sangyo Co., Ltd.) and the like are exemplified. Also, as a method for directly measuring a torque of a stirring blade and determining a solution viscosity from its value, a method in which a required power for stirring is determined from the torque, determining a corresponding Reynolds number from a power characteristic of a stirring blade of every kind and then determining a viscosity of the solution therefrom is also exemplified.

Also, in the step of forming a coagulated particle, for the purpose of measuring the temperature of the dispersion, it is possible to measure the liquid temperature of the dispersion at the coagulation by placing a thermometer in a coagulation container.

Examples of the coagulating agent include a water-soluble metal salt, an inorganic acid and a water-soluble high molecular coagulating agent.

Examples of the water-soluble metal salt which is used in the invention include monovalent metal salts such as sodium chloride, potassium chloride, lithium chloride and sodium acetate; divalent metal salts such as magnesium sulfate, calcium chloride, magnesium chloride and zinc chloride; and trivalent metal salts such as aluminum sulfate, aluminum hydroxide and poly(aluminum chloride).

Of these, monovalent and divalent metal salts are especially desirable in view of a balance between the coagulation rate and the viscosity of the solution.

When an inorganic metal salt is used as the coagulating agent, the heating temperature can be determined by a glass transition point of the binder resin and a valence of the inorganic metal salt as a coagulating agent.

In the case where the valence is monovalent, the coagulation temperature can be made +20° C. of the glass transition point temperature of the binder resin or higher. In the case where the valence is monovalent, when the temperature is lower than +20° C. of the glass transition point temperature, the coagulation of the resin tends to hardly occur.

In the case where the valence is divalent, the coagulation temperature can be made to fall within the range of the glass transition point temperature of the binder resin or higher and not higher than +20° C. of the glass transition point temperature. In the case where the valence is divalent, when the temperature is lower than the glass transition point, even when coagulation occurs, the viscosity of the coagulation solution increases, and the stirring tends to become difficult. Also, when the temperature exceeds +20° C. of the glass transition point temperature, coarse particles tend to be generated at the same time of the dropwise addition of the coagulating agent, and the particle size distribution of the toner tend to be hardly made narrow.

As the dropwise addition of the coagulating agent in the dispersion of the toner particle material, there is a method for collectively adding or dividedly adding it in a prescribed amount or continuously adding it for a certain period of time. In general, since a monovalent inorganic metal salt coagulating agent has a weak cohesive force, a collective addition method is desirable. In the case of a divalent inorganic metal salt coagulating agent, when collectively added, the viscosity of the dispersion of the toner particle material often increases, and therefore, a method for continuously adding the coagulating agent is desirable. All of these methods can be carried out while stirring the dispersion of the toner particle material. Also, the coagulating agent can be added while measuring the viscosity of the dispersion of the toner particle material, and when the viscosity increases, the addition of the coagulating agent can be stopped.

After completion of the formation of a coagulated particle, the coagulated particle can be fused.

The fusion can be carried out by heating the dispersion containing a coagulated particle at a temperature of the glass transition temperature of the resin or higher and holding it for, for example, from 30 minutes to 5 hours.

The progress of coagulation can be stopped by cooling the dispersion containing a coagulated particle to not higher than ordinary temperature (30° C.) prior to the fusion.

Furthermore, a toner particle is obtained by removing the dispersion medium from the dispersion containing a coagulated particle and then drying the residue. The removal of the dispersion medium can be, for example, carried out by separating a solid and a liquid from each other by a centrifuge or the like and removing the liquid.

At that time, the coagulated particle from which the dispersion medium has been removed can be provided for a washing step prior to drying.

The washing can be, for example, carried out by adding a washing liquid, for example, ion exchanged water to the coagulated particle from which the dispersion medium has been removed, providing the dispersion containing the coagulated particle and the washing liquid in a centrifuge or the like to achieve solid-liquid separation and then removing the liquid. The washing can be carried out repeatedly as the need arises. The washing can be repeated while measuring a conductivity of the liquid until the conductivity becomes not more than a prescribed value, for example, 50 μS/cm.

Drying of the coagulated particle can be, for example, carried out by using a vacuum dryer. At that time, it is possible to achieve drying until the water content reaches a desired value, for example, from 0.1 to 1.0%.

In the invention, in order to adjust the fluidity or charge properties of the developing agent, an inorganic fine particle may be externally added and mixed on a surface of the toner particle in an amount of from 0.01 to 20% by weight relative to the total weight of the toner particle. As such an inorganic fine particle, silica, titania, alumina, strontium titanate, tin oxide and so on can be used singly or in admixture of two or more kinds thereof. From the viewpoint of an enhancement of the environmental stability, it is preferred to use an inorganic fine particle which has been subjected to a surface treatment with a hydrophobic agent. In addition to such an inorganic oxide, a resin fine particle of not larger than 1 μm, such as acrylic/styrene resin particles and silicone/acrylic resin particles, may be externally added on the surface of the toner particle in an amount of from 0.01 to 20% by weight relative to the total weight of the toner particle for the purpose of enhancing cleaning properties.

EXAMPLES

The invention is specifically described below with reference to the following Examples.

Figure 2:
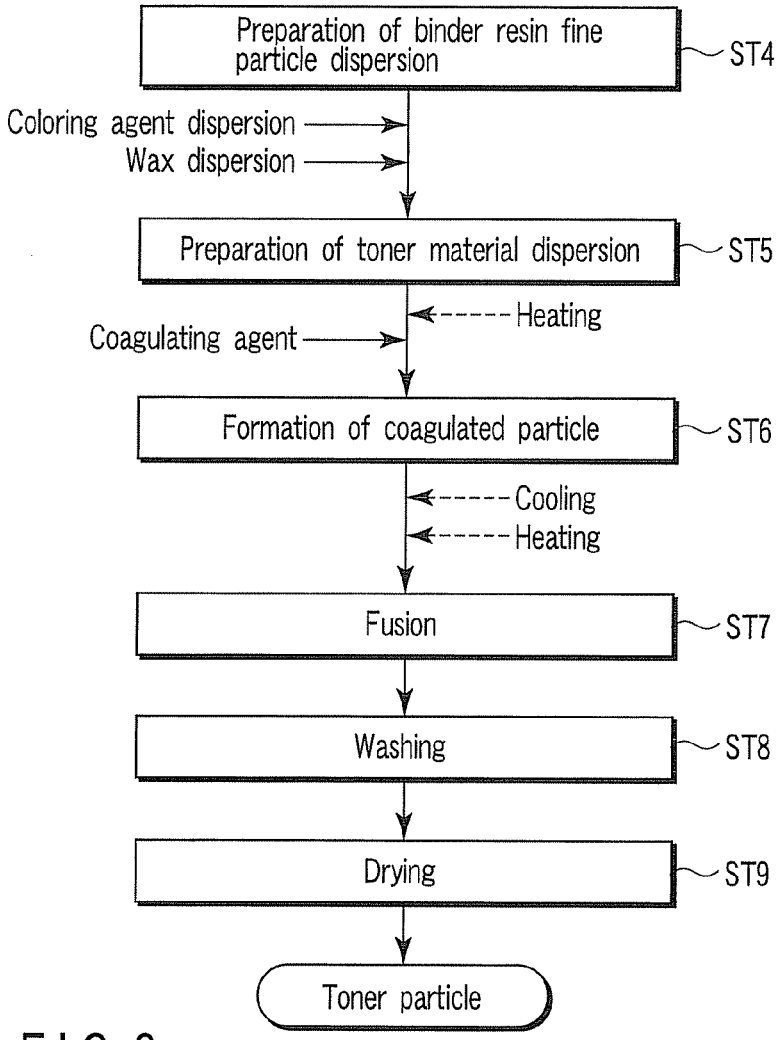
FIG. 2 shows a flow diagram expressing an embodiment of a method for producing a developing agent according to the invention.

FIG. 2 shows a flow diagram expressing an embodiment of a method for producing a developing agent according to the invention.

A binder resin fine particle dispersion, a pigment dispersion and a wax dispersion were previously prepared in the following manner.

Preparation of Binder Resin Fine Particle Dispersion 30 parts by weight of a polyester resin (Tg: 61.5° C., Mw: 13,500, acid value: 22 mg-KOH/g), 4 parts by weight of an anionic surfactant (NEOPELEX G-65, manufactured by Kao Corporation), 1 part by weight of an amine compound (triethylamine, manufactured by Wako Pure Chemical Industries, Ltd.) and 65 parts by weight of ion exchanged water were thrown into CLEAR MIX (CLM-2.2S, manufactured by MTECHNIQUE Co., Ltd.). After the sample temperature reached 80° C., the revolution number of the CLEAR MIX was set up at 18,000 rpm, and the mixture was stirred for 30 minutes to obtain a binder resin fine particle dispersion (ST4). After cooling, a volume average particle size of the resulting resin fine particle was measured by SALD7000 (manufactured by Shimadzu Corporation). As a result, it was found to be 112 nm.

Preparation of Cyan Pigment Dispersion 20 parts by weight of a cyan pigment (copper phthalocyanine, manufactured by Dainichiseika Color & Chemicals Mfg Co., Ltd.), 1 part by weight of an anionic surfactant (NEOPELEX G-65, manufactured by Kao Corporation) and 79 parts by weight of ion exchanged water were mixed, and the mixture was treated for 60 minutes in a homogenizer (ULTRA TURRAX T50, manufactured by IKA Japan K.K.) to obtain a cyan pigment dispersion having a volume average particle size of 207 nm. The measurement of particle size distribution was performed by SALD7000 as manufactured by Shimadzu Corporation.

Preparation of Wax Dispersion 0.20 parts by weight of an ester wax (carnauba wax, manufactured by Toakasei Co., Ltd.), 1 part by weight of an anionic surfactant (NEOPELEX G-65, manufactured by Kao Corporation) and 79 parts by weight of ion exchanged water were mixed, and the mixture was treated for 10 minutes while heating in a homogenizer (manufactured by IKA Japan K.K.) to obtain a wax dispersion having a volume average particle size of 152 nm. The measurement of particle size distribution was performed by SALD7000 as manufactured by Shimadzu Corporation.

Preparation of Toner Particle Material Dispersion 5 parts by weight of the cyan pigment dispersion and 5 parts by weight of the wax dispersion were mixed with 90 parts by weight of the resulting resin fine particle dispersion to prepare a toner particle material dispersion (ST5).

Example 1

Figure 3:
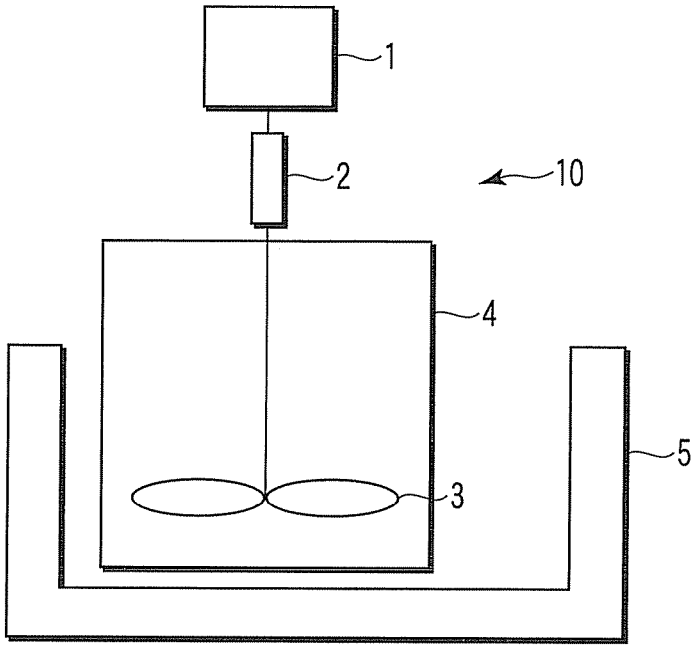
FIG. 3 shows a diagrammatic view expressing an embodiment of an experimental device to be used in the invention.

FIG. 3 shows a diagrammatic view expressing an embodiment of an experimental device to be used in the invention.

This device 10 is an experimental device for performing coagulation of a toner particle material using a dispersion of a toner particle material and is provided with a glass-made separable flask 4 equipped with a stirrer having a motor 1 and a stirring blade 3, a torque meter 2 equipped between the stirrer 3 and the motor 1 and a water bath 5 capable of sufficiently accommodating the separable flask 4 therein. In this experimental device, the relationship between viscosity and torque is previously determined by using a standard substance having a known viscosity and measuring its torque, whereby it is possible to know a viscosity of the dispersion of the toner particle material from a measured torque by this torque meter 2.

70 parts by weight of the previously prepared toner particle material dispersion was charged into the separable flask 4 and heated to 64° C. in the water bath 5 for heating while revolving the stirring blade 3 at 300 rpm. Then, coagulation was carried out in the following manner while continuously adding dropwise a magnesium sulfate aqueous solution having a concentration of 3.5% by weight by a pump (ST6).

Figure 4:
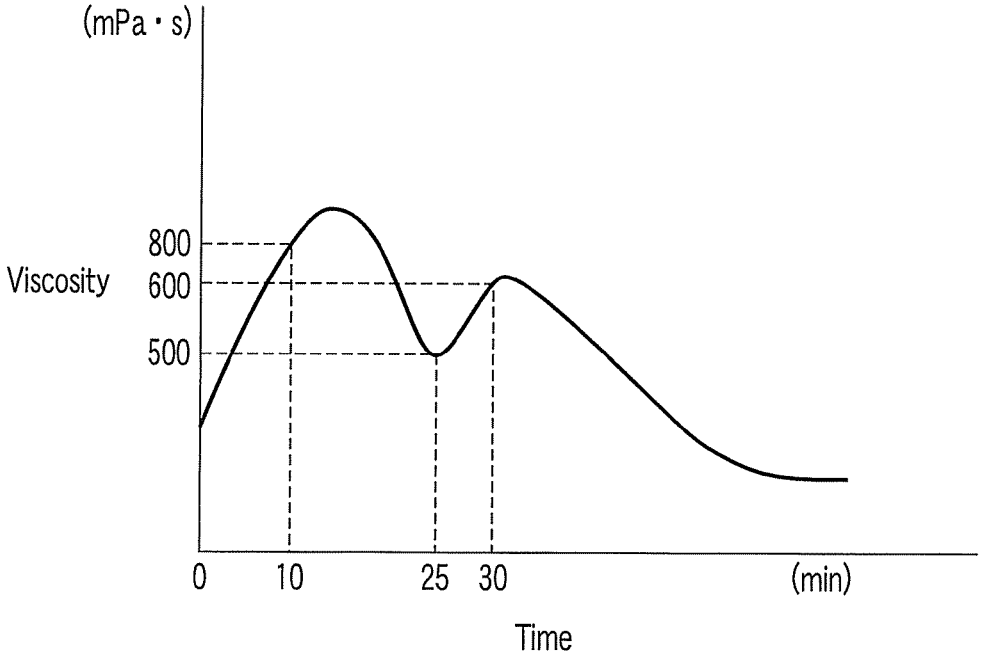
FIG. 4 shows a graph expressing the relationship between time and viscosity in the formation of a coagulated particle.

FIG. 4 shows a graph expressing a change in the viscosity in the formation step of a coagulated particle.

At a point of time of charging 20 parts by weight of the magnesium sulfate aqueous solution (T1; after a lapse of 10 minutes), the feed of the aqueous solution was stopped because the viscosity of the dispersion detected from the torque meter became 800 mPa·s, and heating and stirring were held. At a point of time after a lapse of 15 minutes since T1 (T2; after a lapse of 25 minutes), the viscosity of the dispersion was lowered to 500 mPa·s, and therefore, the feed of the magnesium sulfate aqueous solution was again started. At a point of time after a lapse of 5 minutes since T2 during which the remainder of 10 parts by weight had been continuously added dropwise (T3; after a lapse of 30 minutes), the viscosity of the dispersion was 600 mPa·s. After completion of the dropwise addition, the temperature was kept constantly at 64° C. Thereafter, the coagulation solution was cooled to 30° C., thereby stopping the coagulation step.

1 part by weight an anionic surfactant (NEOPELEX G-65, manufactured by Kao Corporation) was added in this coagulation solution, and for the purposes of controlling the shape and performing fusion, the temperature was increased to 90° C., and the coagulation solution was allowed to stand for 3 hours (ST7).

After cooling, the resulting colored particle was subjected to solid-liquid separation by a centrifuge, and the liquid was discarded. Thereafter, washing was carried out by repeating operations of feeding washing water into the solid, performing stirring, subjecting to solid-liquid separation by a centrifuge and discarding the liquid until the conductivity of the liquid became 50 μS/cm (ST8).

Thereafter, drying was carried out by a vacuum dryer until the water content became 0.3 wt % (ST9), thereby obtaining a toner particle.

After drying, 2 parts by weight of hydrophobic silica (RX-200, manufactured by Nippon Aerosil Co., Ltd.) and 0.5 parts by weight of titanium oxide (STT-30EHJ, manufactured by Titan Kogyo K.K.) as external additives were added in the toner particle, and these external additives were deposited on the toner particle surface by using a ball mill device, whereby a desired electrophotographic toner could be obtained.

A volume average particle size of the resulting electrophotographic toner was measured by a Coulter counter (manufactured by Beckman Coulter Inc.). As a result, it was found to be 6.0 μm, and a proportion of coarse particles of 10 μm or more was 1.2% on a volume basis.

The electrophotographic toner was mixed with a carrier in a prescribed ratio, for example, 7/93 in terms of a weight ratio, and the mixture was thrown into a complex machine e-STUDIO 281c as manufactured by Toshiba Tec Corporation which had been modified for the evaluation and evaluated visually with respect to the print image quality. As a result, a very beautiful image quality was revealed. The obtained results are shown in the following Table 1.

Example 2

A toner particle material dispersion the same as in the foregoing Example 1 was prepared, and 70 parts by weight of this toner particle material dispersion was charged in the device as shown in FIG. 3 and heated at a temperature of 85° C. 100 parts by weight of a sodium chloride aqueous solution having a concentration of 20% was continuously added dropwise therein. Thereafter, the temperature was gradually increased to 95° C., thereby achieving fusion. A maximum viscosity of the coagulation solution was 400 mPa·s. Thereafter, the coagulation solution was cooled, and operations including washing, drying and addition of external additives were carried out in the same manner as in Example 1 to obtain an electrophotographic toner.

A volume average particle size of the resulting electrophotographic toner was 4.5 μm, and a proportion of coarse particles of 10 μm or more was 0.9% on a volume basis.

The foregoing electrophotographic toner was mixed with a carrier in a prescribed ratio, and the mixture was thrown into a complex machine e-STUDIO 281c as manufactured by Toshiba Tec Corporation which had been modified for the evaluation and evaluated with respect to the print image quality. As a result, a very beautiful image quality was revealed. The obtained results are shown in the following Table 1.

Example 3

90 parts by weight of a polyester resin (Tg: 61.5° C., Mw: 13,500, acid value: 22 mg-KOH/g), 5 parts by weight of carbon black as a coloring agent, 4 parts by weight of an ester wax (carnauba wax, manufactured by Toakasei Co., Ltd.) and 1 part by weight of a zirconia metal complex as a charge controlling agent were mixed, and the mixture was melt kneaded by a twin-screw kneader (PCM45, manufactured by Ikegai, Ltd.) set up at a temperature of 120° C. to obtain a kneaded material.

The resulting kneaded material was coarsely pulverized into a volume average particle size of 1.2 mm by a hammer mill as manufactured by Nara Machinery Co., Ltd., thereby obtaining a coarse particle.

40 parts by weight of the coarse particle, 4 parts by weight of sodium dodecylbenzenesulfonate as an anionic surfactant, 1 part by weight of triethylamine as an amine compound and 55 parts by weight of ion exchanged water were thrown into CLEAR MIX (manufactured by MTECHNIQUE Co., Ltd.).

After heating the dispersion in the CLEAR MIX to 80° C., the revolution number of the CLEAR MIX was set up at 6,000 rpm, and mechanical shearing was carried out for 30 minutes. After completion of the mechanical shearing, the dispersion was cooled to ordinary temperature.

The thus obtained dispersion was subjected to coagulation, fusion, washing, drying and addition of external additives in the same manner as in Example 1, thereby obtaining an electrophotographic toner. A volume average particle size of the electrophotographic toner was 5.0 μm, and a proportion of coarse particles of 10 μm or more was 1.5% on a volume basis.

The electrophotographic toner was mixed with a carrier in a prescribed ratio, for example, 7/93 in terms of a weight ratio, and the mixture was thrown into a complex machine e-STUDIO 281c as manufactured by Toshiba Tec Corporation which had been modified for the evaluation and evaluated with respect to the print image quality. As a result, a very beautiful image quality was revealed. The obtained results are shown in the following Table 1.

Comparative Example 1

A toner particle material dispersion the same as in Example 1 was used, and a magnesium sulfate aqueous solution was added dropwise at a heating temperature of 30° C. Thereafter, the temperature was gradually increased to 60° C. As a result, the viscosity of the coagulation solution became 6,000 mPa·s or more, whereby stirring became no longer possible. A large amount of coarse particles were generated.

Comparative Example 2

A toner particle material dispersion the same as in Example 1 was used, and an aluminum sulfate aqueous solution was added dropwise at a temperature of 64° C. Following the dropwise addition, coarse particles were generated. A maximum viscosity of the coagulation solution was 1,000 mPa·s. Thereafter, the coagulation solution was cooled, and the same operations as in Example 1 were carried out to obtain an electrophotographic toner. A volume average particle size of the foregoing electrophotographic toner was 7.0 μm, and a proportion of coarse particles of 10 μm or more was 10% on a volume basis.

The foregoing electrophotographic toner was mixed with a carrier in a prescribed ratio, and the mixture was thrown into a complex machine e-STUDIO 281c as manufactured by Toshiba Tec Corporation which had been modified for the evaluation and evaluated with respect to the print image quality. As a result, a rough image was revealed.

The used polyester resins are as follows.

Polyester resin 1:

(Tg: 61° C., Mw: 4,000, Acid Value: 15 mg-KOH/G)

Polyester resin 2:

(Tg: 61° C., Mw: 12,500, Acid Value: 17 mg-KOH/G)

Polyester resin 3:

(Tg: 60° C., Mw: 15,000, Acid Value: 18 mg-KOH/G)

Polyester resin 4:

(Tg: 61° C., Mw: 60,000, Acid Value: 21 mg-KOH/G)

In the case of using a polyester resin having an Mw in the range of from 5,000 to 50,000, there were no problems with respect to the preparation of a resin fine particle dispersion and the image quality of an image by the obtained toner. On the other hand, in the case of using a polyester resin having an Mw of less than 5,000, the hot off-set resistance at the fixation was slightly deteriorated because of a lowering of the elasticity of the toner.

Also, in the case of using a polyester resin having an Mw exceeding 50,000, the low-temperature fixability was slightly lowered because a softening point of the resin is generally high.

TABLE 1

| | Resin fine particle | Tg (° C.) | Kind of coagulating agent | Starting temperature of coagulation (° C.) | Finishing temperature of coagulation (° C.) | Maximum viscosity (mPa · s) | Average particle size (μm) | Percentage of coarse particles (10 μm or more) | Image quality |
|---|---|---|---|---|---|---|---|---|---|
| Example 1 | Polyester | 61.5 | $MgSO_4$ | 64 | 64 | 800 | 6.0 | 1.2 | Good |
| Example 2 | Polyester | 61.5 | NaCl | 85 | 95 | 350 | 4.5 | 0.9 | Good |
| Example 3 | Polyester (kneaded, coarsely pulverized material) | 61.5 | $MgSO_4$ | 64 | 64 | 350 | 5.0 | 1.2 | Good |
| Comparative Example 1 | Polyester | 61.5 | $MgSO_4$ | 30 | — | ≧6,000 | — | — | Evaluation impossible |
| Comparative Example 2 | Polyester | 61.5 | $Al_2(SO_4)_3$ | 64 | 64 | 1,000 | 7.0 | 10 | Bad |

In a styrene based resin of the related-art polymer toner, by adding dropwise mainly a water-soluble inorganic metal salt or the like as a coagulating agent at a temperature of not higher than the glass transition point, a toner having a sharp particle size distribution was obtained. On the other hand, recently, a polyester based resin is frequently used as a toner because low-temperature fixing is required. However, in carrying out the coagulation step by using a polyester based resin, in the case where the coagulating agent was fed at a temperature of not higher than the glass transition point, when the temperature reached close to the glass transition point, the viscosity of the coagulation solution increased, whereby a state of impossible stirring was generated. Then, in particular, by carrying out the coagulation step by using a monovalent or divalent water-soluble inorganic metal salt while controlling the amount of the coagulating agent and the temperature such that the viscosity of the coagulation solution was not more than 1,000 mPa·s, an electrophotographic toner having a sharp particle distribution and containing less coarse particles could be obtained.

Examples 4 to 7

Electrophotographic toners were obtained in the same manner as in Example 1, except for using a polyester resin having substantially the same Tg and acid value and having a different Mw.

Examples 8 to 11

Electrophotographic toners were obtained in the same manner as in Example 1, except for using a polyester resin having substantially the same Mw and acid value and having a different Tg.

The used polyester resins are as follows.

Polyester resin 5:

(Tg: 40° C., Mw: 12,500, Acid Value: 18 mg-KOH/G)

Polyester resin 6:

(Tg: 55° C., Mw: 11,000, Acid Value: 20 mg-KOH/G)

Polyester resin 7:

(Tg: 60° C., Mw: 9,000, Acid Value: 21 mg-KOH/G)

Polyester resin 8:

(Tg: 72° C., Mw: 15,000, Acid Value: 16 mg-KOH/G)

In the case of using a polyester resin having a Tg in the range of from 45 to 70° C., there were no problems with respect to the preparation of a resin fine particle dispersion and the image quality of an image by the obtained toner. On the other hand, in the case of using a polyester resin having a Tg of lower than 45° C., the heat-resistant preservability of the toner was slightly deteriorated.

Also, in the case of using a polyester resin having a Tg exceeding 70° C., the low-temperature fixability was slightly lowered.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for producing a developing agent comprising the steps of:

heating a dispersion of a toner particle material containing a binder resin fine particle, a coloring agent particle and a dispersion medium at a temperature of a glass transition point of the binder resin or higher and adding a coagulating agent consisting of a water-soluble inorganic metal salt in which the metal is a monovalent or divalnet in the heated dispersion of the toner particle material at a temperature of a glass transition point of the binder resin or higher to coagulate the toner material containing the binder resin fine particle and the coloring agent particle to obtain-a coagulated particle;

fusing the obtained coagulated particle; and removing the dispersion medium from the dispersion containing the coagulated particle to obtain a toner particle.

2. The method for producing a developing agent according to claim 1, wherein the binder resin fine particle has an acidic polar group.

3. The method for producing a developing agent according to claim 1, wherein the coagulating agent is continuously added dropwise in the heated dispersion of a toner particle material.

4. The method for producing a developing agent according to claim 1, wherein in the step of forming a coagulated particle, the addition amount of the coagulating agent and the coagulation temperature are controlled such that a viscosity of the toner material dispersion is not more than 1,000 mPas.

5. The method for producing a developing agent according to claim 1, wherein the dispersion medium is an aqueous solvent.

* * * * *